United States Patent [19]

Helms et al.

[11] 4,453,630

[45] Jun. 12, 1984

[54] REINFORCED MULTI-ARTICLE CARRIER

[75] Inventors: Charles R. Helms, Malvern; John V. Bousum, Downingtown; Richard T. Walters, Norristown; William H. Carr, West Chester, all of Pa.

[73] Assignee: Container Corporation of America, Chicago, Ill.

[21] Appl. No.: 439,085

[22] Filed: Nov. 4, 1982

[51] Int. Cl.[3] ..... B65D 71/00; B65D 25/22

[52] U.S. Cl. ..... 206/158; 206/148; 206/161; 206/147; 294/87.2

[58] Field of Search ..... 206/145–161, 206/620; 294/87 R, 87.2

[56] References Cited

U.S. PATENT DOCUMENTS

| | | | |
|---|---|---|---|
| 3,085,683 | 4/1963 | Harrison | 206/158 |
| 3,154,617 | 10/1964 | Schenk et al. | 220/338 |
| 3,528,697 | 9/1970 | Wood | 206/158 |
| 3,752,305 | 8/1973 | Heyne | 206/147 |
| 4,190,149 | 2/1980 | Oliff et al. | 206/148 |
| 4,235,468 | 11/1980 | Erickson | 206/151 |
| 4,247,142 | 1/1981 | Erickson | 294/87.2 |
| 4,249,766 | 2/1981 | Erickson | 294/87.2 |
| 4,305,500 | 12/1981 | Jaeschke | 206/153 |
| 4,332,325 | 6/1982 | Manizzo | 206/158 |
| 4,365,835 | 12/1982 | Quelch | 206/150 |

FOREIGN PATENT DOCUMENTS

| | | | |
|---|---|---|---|
| 478697 | 11/1969 | Switzerland | 294/87.2 |

*Primary Examiner*—William T. Dixson, Jr.
*Assistant Examiner*—Brenda J. Ehrhardt
*Attorney, Agent, or Firm*—Richard W. Carpenter

[57] ABSTRACT

A carrier for holding a plurality of articles which includes a shell formed of relatively thin printable sheet material having a molded plastic frame bonded to the underside thereof.

30 Claims, 18 Drawing Figures

REINFORCED MULTI-ARTICLE CARRIER

BACKGROUND OF THE INVENTION

1. Field of the Invention

This invention relates to multi-pack carriers, and more particularly to a carrier including a shell formed of a relatively thin sheet material having reinforced openings for snugly receiving and retaining upper portions of packaged articles such as bottles or cans.

2. Description of the Prior Art

A prior art search directed to the subject matter of this application in the U.S. Patent and Trademark Office disclosed the following U.S. Pat. Nos.: 2,401,578; 2,441,346; 2,487,109; 2,520,203; 2,892,540; 2,936,070; 3,199,908; 3,373,867; 3,443,685; 3,460,863; 3,567,016; 3,621,628; 3,688,899; 3,721,337; 3,757,983; 3,785,484; 3,884,354; 3,923,155; 3,938,656; 4,022,363; 4,139,094; 4,190,149; 4,304,329; Canadian Pat. No. 655,425.

None of the prior art patents uncovered in the search disclosed a carrier including a shell formed of relatively thin printable sheet material and having a molded plastic frame bonded to the underside thereof to reinforce the article receiving openings, the finger openings, and the corners of the shell.

SUMMARY OF THE INVENTION

It is an object of the invention to provide an improved multi-pack carrier for transporting a plurality of preferably cylindrical articles such as bottles or cans.

Another object of the invention is the provision, in a carrier of the type described, of a unique construction employing a relatively thin shell formed of a printable sheet material, such as paperboard, and which is reinforced by a molded plastic frame bonded to the underside thereof.

A more specific object of the invention is the provision of a composite multi-pack carrier including an outer shell formed of a relatively thin printable sheet material which has a plurality of openings for accepting and holding upper portions of packaged articles and wherein the openings are reinforced by a molded plastic, skeletal frame bonded to the underside of the shell.

These and other objects of the invention will be apparent from an examination of the following description and drawings.

It will be understood that, for purposes of clarity, certain elements may have been intentionally omitted from certain views where they are believed to be illustrated to better advantage.

DESCRIPTION OF THE PREFERRED EMBODIMENT

Figure 1:
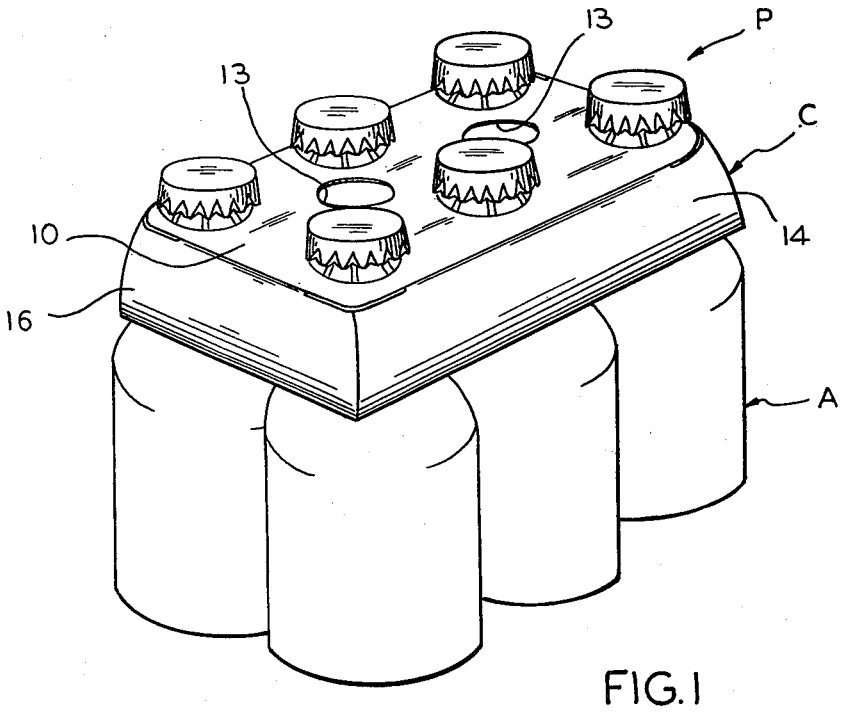
FIG. 1 is a fragmentary perspective view of a package including a carrier embodying features of the present invention.

Referring now to the drawings for a better understanding of the invention, and first to FIG. 1, there is illustrated a package, indicated generally at P, for holding a plurality of articles A, such as bottles, by means of a novel composite carrier, indicated generally at C.

Figure 4:
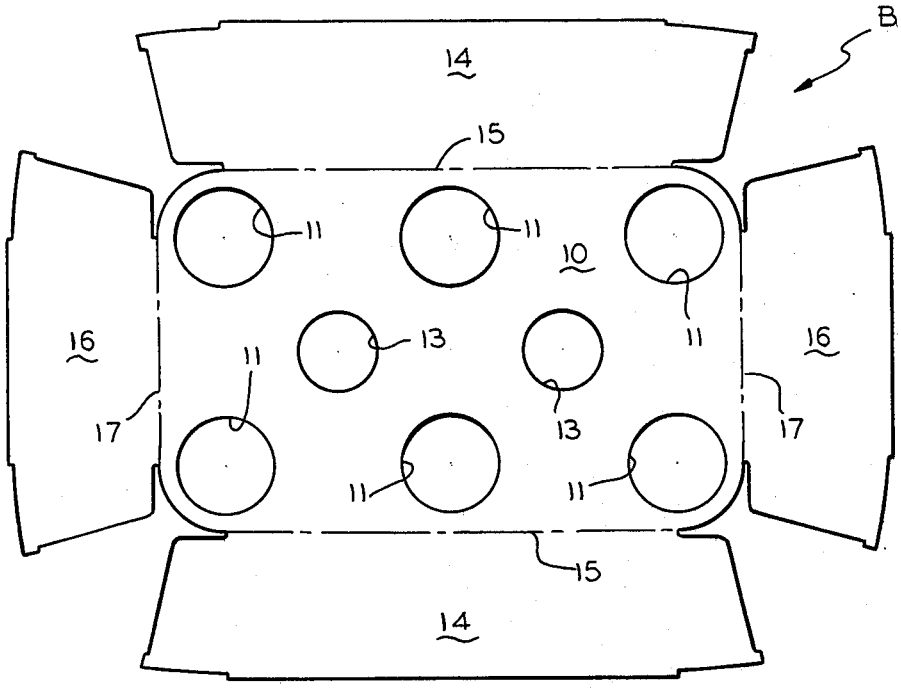
FIG. 4 is a plan view of a blank of foldable sheet material from which the shell portion of the carrier illustrated in the other views may be formed.

Carrier C includes an outer shell S, which may be formed from a unitary blank B of printed sheet material, such as paperboard, illustrated in FIG. 4, and a molded plastic, skeletal type frame indicated, generally at F, which is bonded to the underside of the shell in an insert injection molding process of the type described in U.S. Pat. No. 3,154,617.

As best seen in FIGS. 1 and 4, shell S includes a relatively flat, generally rectangular top panel 10 having a plurality of openings 11 extending therethrough for receiving upper portions of packaged articles such as bottles or cans. Top panel 10 also includes a pair of spaced openings 13 which are designed to facilitate grasping and lifting of the package.

Shell S also includes opposed pairs of side panels 14 and end panels 16 which are foldably joined along fold lines 15 and 17 to the side and end edges, respectively, of top panel 10 to form therewith a cover for enclosing upper portions of the packaged articles.

In order to permit the shell to be formed of sheet material which is relatively thin so as to be less expensive than thicker materials, the invention contemplates the idea of reinforcing the openings of the shell, as well as the corners of the shell, by a skeletal type molded plastic frame indicated generally at F. As previously mentioned, the frame is formed by inserting the shell into an injection mold and then inserting the plastic in an insert injection molding process.

Figure 2:
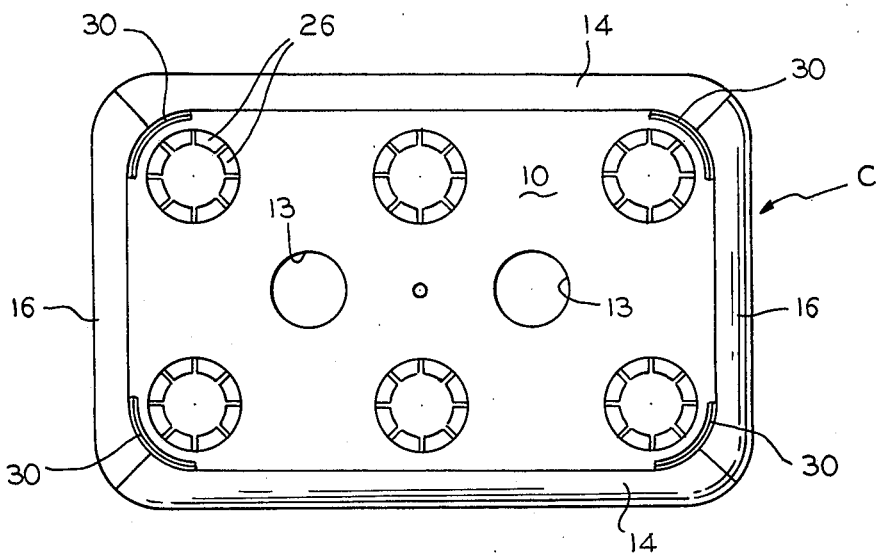
FIG. 2 is a fragmentary plan view, as seen from the top, of the novel carrier illustrated in FIG. 1.
Figure 3:
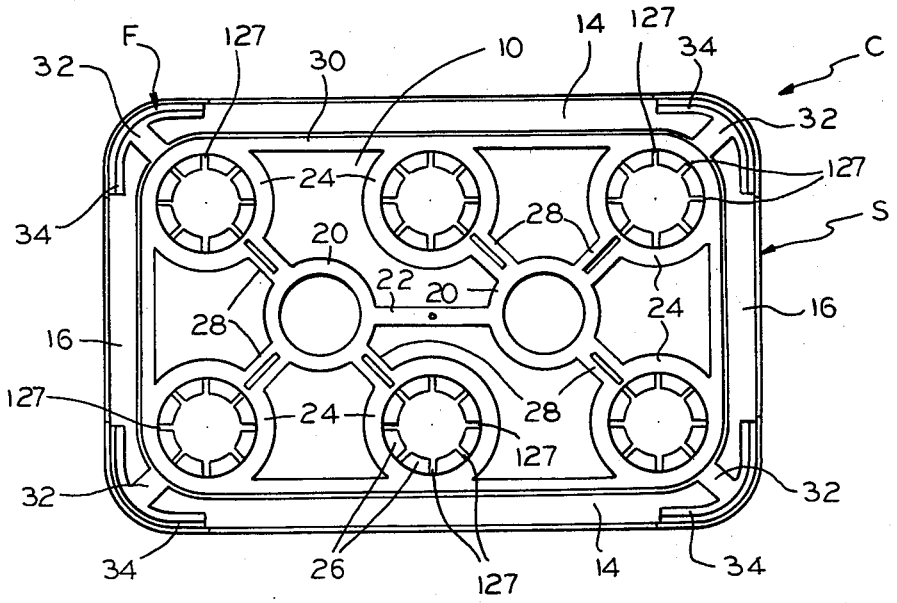
FIG. 3 is a plan view the underside of the carrier.

As best seen in FIGS. 2 and 3, frame F includes a plurality of reinforcing ring elements 24 which are disposed around the article receiving holes 11 in the shell top panel. The ring elements or collars 24 may, in certain cases, include a plurality of radially inwardly extending, circumferentially spaced fingers or tabs 26 which project into the opening for engagement with the caps of packaged bottles or with the chimes or packaged cans.

The frame F also includes a plurality of reinforcing ring elements or collars 20 which are disposed to surround the lifting, openings, or finger holes 13 in the top panel of the shell.

As best seen in FIG. 3, reinforcing rings 20 are preferably connected to each other by a strut 22 of the frame and are connected to the other reinforcing rings 24 by means of other struts 28. It should be understood, however, that it is not essential for all of the reinforcing rings to be interconnected. Although not shown, an acceptable alternate arrangement could omit certain of the struts.

Still referring to FIG. 3 it will be seen that the frame includes a preferably rectangular, though rounded at the corners, outer connecting rim 30 which surrounds top panel 10 at the junctures of the top panel with the side and end panels.

Also, extending downwardly from the upper corners of the carrier are a plurality of corner ribs 32 which are formed integrally with the outer connecting rim 30 and which, in turn, have formed integrally with their lower ends horizontal bars 34, which extend a short distance in opposite directions from the lower ends of ribs 32 to form generally T-shaped structures reinforcing the carrier at the lower portions of its corners.

Figure 5:
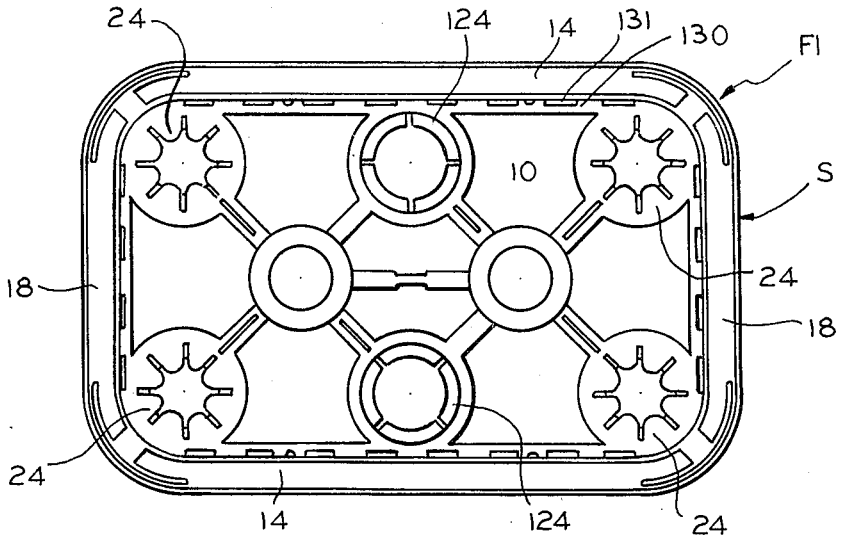
FIG. 5 is a view similar to that of FIG. 3, but illustrating a modified form of the invention.

Referring to FIG. 5, it will be seen that a slightly modified form of the invention is shown. In this view as well as in the views illustrating other embodiments of the invention, portions of the structure corresponding to portions of the earlier illustrated embodiment are designated by related numerals.

The shell structure of FIG. 5 is basically the same as that of the previously described embodiment. The frame structure differs in several respects.

It will be noted that the outer connecting rim 130 of the frame F1 is not solid, but is provided with a plurality of openings 131 which permit the use of a lesser quantity of plastic material in forming the rim.

Figure 6:
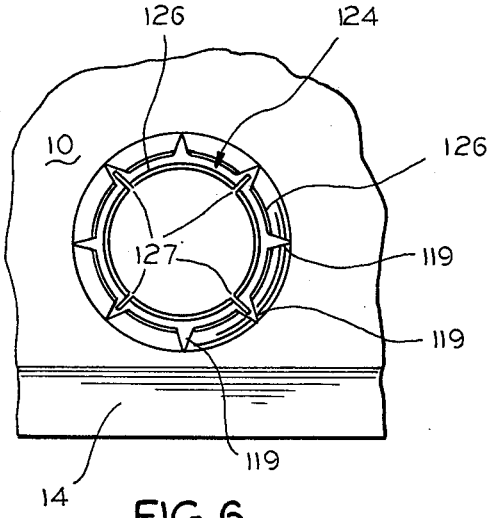
FIG. 6 is an enlarged fragmentary top plan view of a center article receiving reinforced opening area of the structure of FIG. 5.

As best seen in FIGS. 5 and 6, in the center article receiving openings the radially inner portion of the ring or collar 124 projects above the plane of the shell, and the ends of the fingers 126 are squared off, rather than being rounded as in the case of the other collars 24.

This provides for a more snug engagement between the carrier collar and the upper portion of the article carried. In order to accommodate the projection of the collars 124, the area of the shell top panel 10 may be provided with a plurality of circumferentially spaced V-shaped notches 119.

Figure 7:
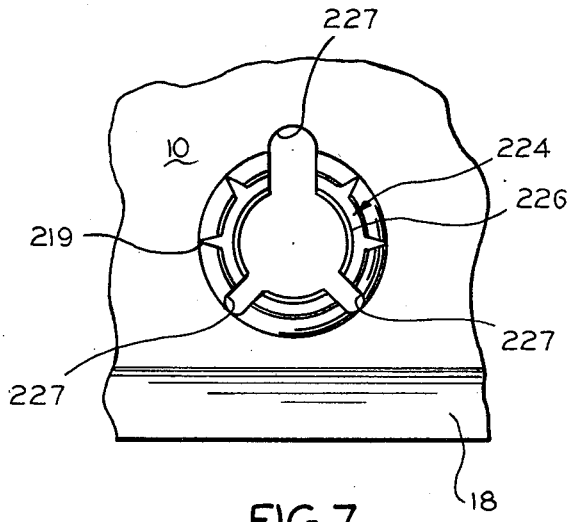
FIGS. 7–11 are views similar to that of FIG. 6, but illustrate modified forms of the invention.
Figure 8:
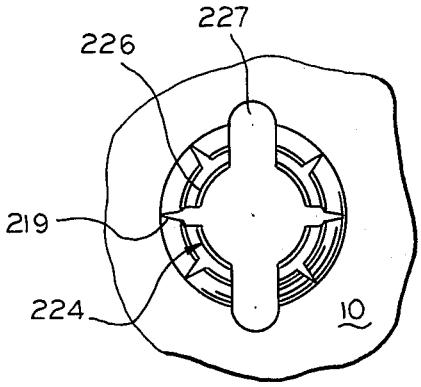

In the form of the invention illustrated in FIGS. 7 and 8 the openings 227 between the fingers 226 of collar 224 have been enlarged to relieve stress and make it easier to remove an article from the opening, but still prevent the article from coming out accidentally.

Figure 9:
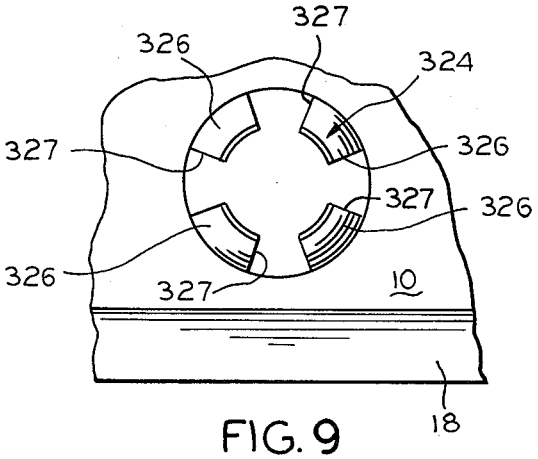
Figure 10:
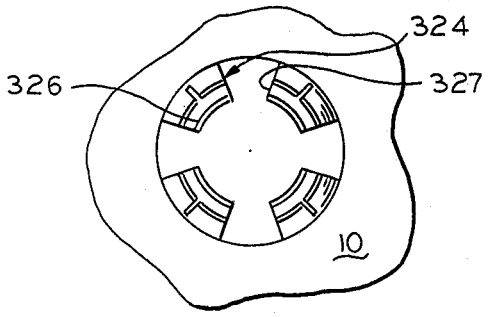

In the form of the invention illustrated in FIGS. 9 and 10, it will be seen that the fingers 326 of collar 324 extend inwardly well beyond the edge of the shell openings and also that the slots 327 between adjacent fingers is larger than in previous embodiments of the invention.

Figure 11:
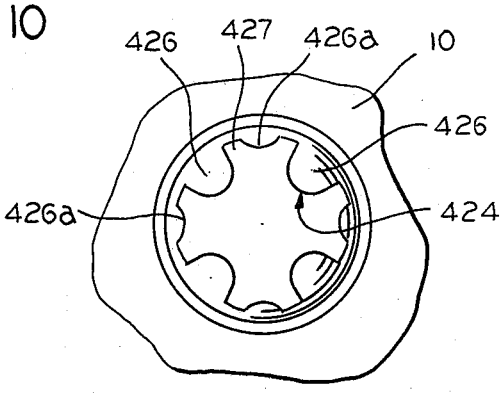

As best seen in FIG. 11, a slightly modified form of the invention is shown, wherein every other finger 426 of collar 424 is larger than the adjacent finger 426*a*.

Figure 12:
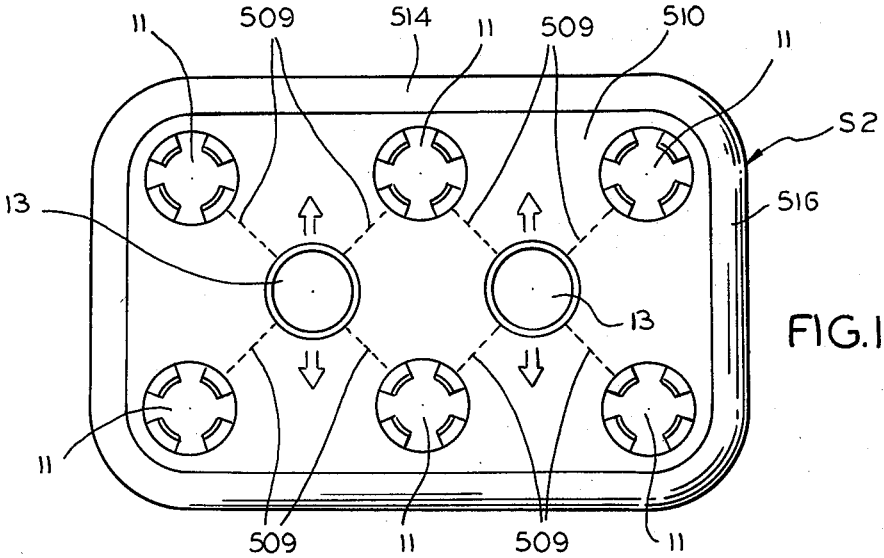
FIG. 12 is a view similar to that of FIG. 2, but illustrates anothwer form of the invention.

In FIG. 12, a modified form of the invention is illustrated. In this embodiment shell S2 is provided with weakened lines of tear 509 which extend diagonally outward from finger openings 13 to article receiving holes 11. The struts (not shown) of the frame under the top panel 510 may also be provided with aligned weakened lines or notches to facilitate tearing of structure to remove the packaged articles.

Figure 13:
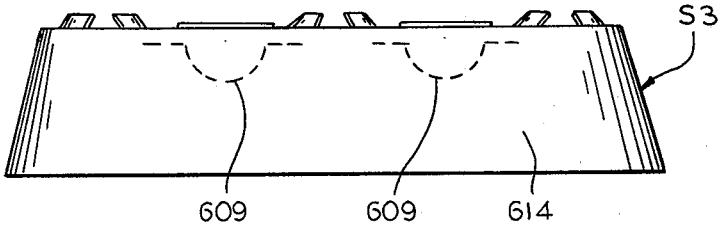
FIG. 13 is a side elevational view of a carrier but illustrates another embodiment of the invention.

As best seen in FIG. 13, another form of the invention is shown, wherein the side panels 614 are provided with contoured weakened lines of tear 609 to facilitate opening the carrier and removing the packaged articles.

Figure 14:
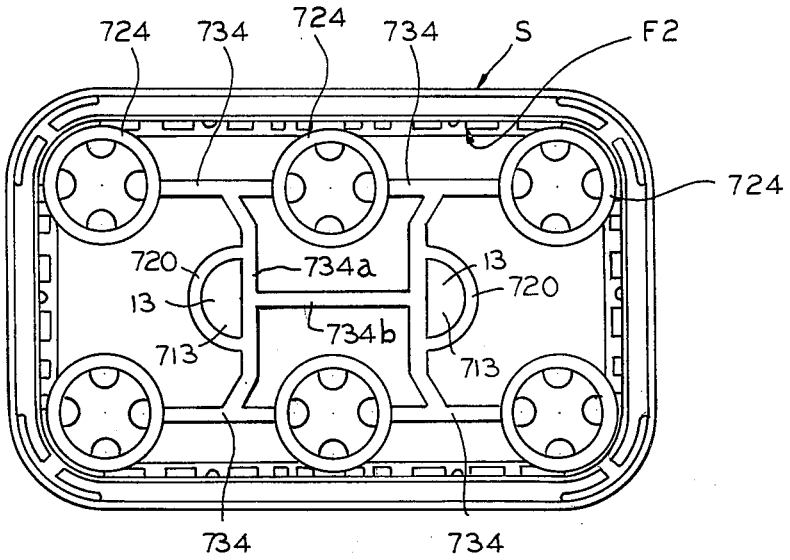
FIG. 14 is a view similar to that of FIGS. 3 and 5, but illustrates still another form of the invention.
Figure 15:
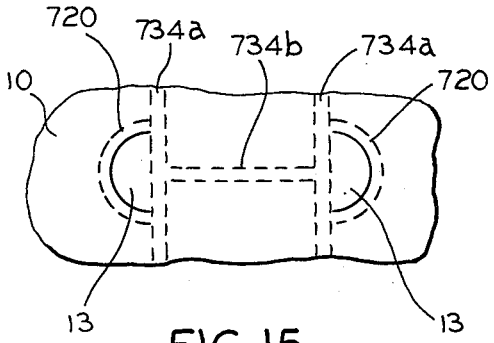
FIG. 15 is a fragmentary top plan view of a portion of the structure illustrated in FIG. 14.

Yet another embodiment of the invention is illustrated in FIGS. 14 and 15 where the Shell S is the same as that of the first described embodiment, but the Frame F2 differs in certain respects.

In this embodiment, the article receiving collars 724 on each side of the carrier are interconnected by a pair of struts 734, and the struts on opposite sides of the carrier are, in turn, connected to each other by cross struts 734*a*, which are again in turn connected to each other by a center strut 734*b*.

Reinforcement of finger holes 13 is accomplished by a pair of semi-circular loops 720 extending outwardly from cross struts 734*a* around finger openings 13.

Figure 17:
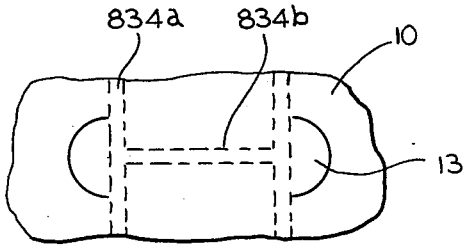
FIGS. 16 and 17 are fragmentary views similar to those of FIGS. 14 and 15 but illustrate yet another embodiment of the invention.
Figure 16:
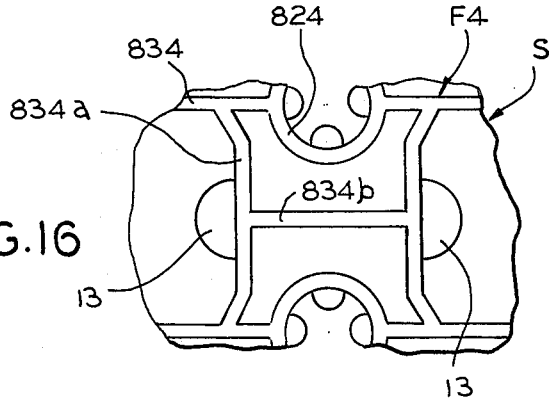
Figure 18:
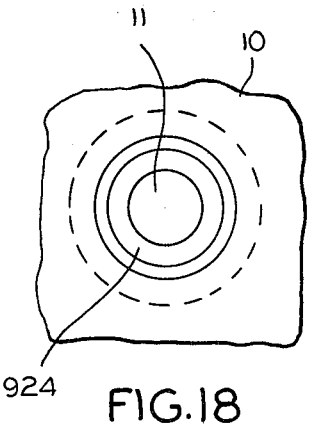
FIG. 18 is a view similar to those of FIGS. 7–11, but illustrate one other embodiment of the invention.

The embodiment illustrated in FIGS. 16 and 17 is the same as that of FIGS. 14 and 15, except for the omission of loops around finger openings 13 in the shell. In FIG. 18, there is illustrated a fragmentary view similar to that of FIG. 6 wherein the article receiving hole 11 in the shell top panel 10 includes a reinforcing ring element 924 which is disposed around and projects within the hole 11. The ring element 924 lies above the plane of the panel 10.

Thus, it will be appreciated that the invention provides a unique way to form a composite multi-pack carrier wherein the major portion of the carrier, namely the shell, may be formed from a relatively thin inexpensive sheet material and may be reinforced in the critical areas by a molded plastic skeletal frame. Although various embodiments of the invention have been illustrated and described, it will be understood that, in spite of structural differences between them, they all embody the same basic principles of construction and operation.

What is claimed is:

1. A carier for holding a plurality of articles, such as bottles or cans, which have adjacent the upper ends of their bodies radially outward extending portions, such as caps, beads or chimes, and which are arranged in at least one row, said carrier comprising:

(a) a shell formed from a unitary blank of a relatively thin printable sheet material and including a relatively flat, generally rectangular top panel having opposed pairs of side and end panels foldably joined to the side and end edges thereof and extending downwardly and outwardly therefrom;

(b) said top panel covering portions of said articles and having extending therethrough:

(i) a plurality of first openings for receiving upper portions of said articles with said radially outward extending portions thereof positioned on the upper side of said shell;

(ii) a pair of spaced second openings for accommodating the grasping and lifting of said carrier;

(c) a unitary, molded plastic, skeletal frame being in contact with portions of the underside of said shell and being bonded thereto in critical areas providing a reinforcement arrangement, said frame including:

(i) generally round ring elements surrounding each of said first openings and disposed therein in reinforcing engagement presenting a smaller opening for engagement with said articles;

(ii) generally straight inner strut elements connecting certain of said ring elements to each other;

(iii) a generally rectangular outer rim element surrounding said shell top panel and interconnecting outer portions of certain of said ring elements;

(iv) corner rib elements extending downwardly from the corners of said outer rim element between adjacent side and end panels of said shell;

(v) lower flange elements joined to lower ends of respective corner rib elements and extending transversely therefrom to form therewith generally T-shaped structures.

2. A carrier for holding a plurality of articles, such as bottles or cans, which have adjacent the upper ends of their bodies radially outward extending portions, such as caps, beads or chimes, and which are arranged in at least one row, said carrier comprising:

(a) a shell formed from a unitary blank of relatively thin printable sheet material and including a relatively flat, generally rectangular top panel having opposed pairs of side and end panels foldably joined to the side and end edges thereof and extending downwardly therefrom;

(b) said top panel covering portions of said articles and having extending therethrough:

(i) a plurality of first openings for receiving upper portions of said articles with said radially outward extending portions thereof positioned on the upper side of said shell;

(ii) a pair of spaced second openings for accommodating the grasping and lifting of said carrier;

(c) a unitary, molded plastic, skeletal frame being in contact with portions of the underside of said shell and being bonded thereto in critical areas providing a reinforcement arrangement, said frame including:

(i) generally rounded ring elements surrounding each of said first openings and disposed therein in and reinforcing engagement presenting a smaller opening for engagement with said articles;

(ii) generally straight inner strut elements connecting certain of said ring elements to each other;

(iii) a generally rectangular outer rim element surrounding said shell top panel and interconnecting outer portions of certain of said ring elements;

(iv) corner rib elements extending downwardly from the corners of said outer rim elements between adjacent side and end panels of said shell.

3. A carrier for holding a plurality of articles, such as bottles or cans, which have adjacent the upper ends of their bodies radially outward extending portions, such as caps, beads or chimes, and which are arranged in at least one row, said carrier comprising:

(a) a shell formed from a unitary blank of a relatively thin printable sheet material and including a relatively flat, generally rectangular top panel;

(b) said top panel covering portions of said articles and having extending therethrough;

(i) a plurality of first openings for receiving upper portions of said articles with said radially outward extending portions thereof positioned on the upper side of said shell;

(ii) a pair of spaced second openings for accommodating the grasping and lifting of said carrier;

(c) a unitary, molded plastic, skeletal frame being in contact with portions of the underside of said shell and being bonded thereto in critical areas providing a reinforcement arrangement, said frame including:

(i) generally round ring elements surrounding each of said first openings and disposed therein in reinforcing engagement presenting a smaller opening for engagement with said articles;

(ii) generally straight inner strut elements connecting certain of said ring elements to each other;

(iii) a generally rectangular outer rim element surrounding said shell top panel and interconnecting outer portions of certain of said ring elements.

4. A carrier for holding a plurality of articles, such as bottles or cans, which have adjacent the upper ends of their bodies radially outward extending portions, such as caps, beads or chimes and which are arranged in at least one row, said carrier comprising:

(a) a shell formed from a unitary blank of a relatively thin printable sheet material and including a relatively flat, top panel;

(b) said top panel covering portions of said articles;

(c) a molded plastic, skeletal frame being in contact with portions of said shell and being bonded therealong to at least one surface of said shell in critical areas providing a reinforcement engagement; and (d) said skeletal frame including means engaging the radially outward extending portions of said articles.

5. A carrier according to claim 4, wherein said shell top panel also has extending therethrough at least one opening for accommodating the grasping and lifting of said carrier.

6. A carrier according to claim 4, wherein said frame also includes a generally rectangular outer rim element surrounding said shell top panel and interconnecting outer portions of certain of said ring elements.

7. A carrier according to claim 4, and including opposed pairs of side and end panels foldably joined to and extending downwardly from opposed side and end edges of said shell top panel.

8. A carrier according to claim 7, wherein said frame also includes a generally rectangular outer rim element surrounding said shell top panel and interconnecting outer portions of said ring elements.

9. A carrier according to claim 7, wherein said frame also includes:

(a) a generally rectangular outer rim element surrounding said shell top panel and interconnecting outer portions of said ring elements;

(b) corner rib elements extending downwardly from the corners of said outer rim element between adjacent side and end panels of said shell.

10. A carrier according to claim 7, wherein said frame also includes:

(a) a generally rectangular outer rim element surrounding said shell top panel and interconnecting outer portions of said ring elements;

(b) corner rib elements extending downwardly from the corners of said outer strut element between adjacent side and end panels of said shell;

(c) lower flange elements joined to lower ends of respective corner rib elements and extending transversely therefrom.

11. A carrier according to claim 4, wherein said shell is formed of paperboard.

12. A carrier according to claim 4, wherein said ring elements each includes a plurality of circumferentially spaced locking fingers extending radially therefrom into the related shell opening for engagement with the outwardly extending portions of a packaged article.

13. A carrier according to claim 4, wherein said frame is a unitary structure.

14. A carrier according to claim 4, wherein said frame is bonded to the underside of said shell.

15. A carrier according to claim 4, and including generally straight strut elements connecting certain of said rings to each other.

16. A carrier according to claim 12, wherein the free ends of said fingers are rounded.

17. A carrier according to claim 12, wherein the free ends of said fingers are rectilinear.

18. A carrier according to claim 12, wherein said fingers are generally triangular in shape.

19. A carrier according to claim 6, wherein said rim element has a plurality of spaced openings therein.

20. A carrier according to claim 4, wherein certain of said ring elements project above the plane of said shell.

21. A carrier according to claim 2, wherein said ring elements include fingers which are spaced from each other by radially extending slots.

22. A carrier according to claim 12, where said fingers are of varying sizes.

23. A carrier according to claim 22, wherein every other of said fingers is larger than an adjacent of said fingers.

24. A carrier according to claim 4, wherein said shell top panel presents weakened lines of tear radiating from certain of said openings to facilitate opening of said carrier and removal of packaged articles.

25. A carrier according to claim 24, wherein said carrier frame presents lines of weakness which are aligned with certain of the lines of weakness of said shell top panel.

26. A carrier according to claim 4, wherein said frame includes:

(a) first strut elements interconnecting the ring elements on each side of said carrier;

(b) second strut elements interconnecting corresponding first strut elements;

(c) a third strut element interconnecting said second strut elements.

27. A carrier according to claim 1, wherein portions of said ring elements are disposed on opposite sides of said top panel.

28. A carrier according to claim 7, wherein said shell side panels have weakened lines of tear therein to facilitate opening of said carrier.

29. A carrier according to claim 4, wherein said shell top panel is generally rectangular.

30. A carrier according to claim 4, wherein said engaging means includes generally round ring elements.

* * * * *